United States Patent [19]

Röck et al.

[11] 4,304,028

[45] Dec. 8, 1981

[54] HINGE

[75] Inventors: Erich Röck, Höchst; Bernhard Mages, Dornbirn, both of Austria

[73] Assignee: Julius Blum Gesellschaft m.b.H., Höchst, Austria

[21] Appl. No.: 90,069

[22] Filed: Oct. 31, 1979

[30] Foreign Application Priority Data

Nov. 20, 1978 [AT] Austria ..... 8241/78

[51] Int. Cl.[3] ..... E05D 7/04

[52] U.S. Cl. ..... 16/131

[58] Field of Search ..... 16/130, 131, 132, 133

[56] References Cited

U.S. PATENT DOCUMENTS

| | | | |
|---|---|---|---|
| 3,913,173 | 10/1975 | Röck et al. | 16/130 |
| 3,965,530 | 6/1976 | Röck et al. | 16/130 |
| 3,977,042 | 8/1976 | Lautenschlager | 16/130 |
| 4,045,841 | 9/1977 | Röck et al. | 16/129 |
| 4,068,349 | 1/1978 | Röck et al. | 16/131 |
| 4,131,968 | 1/1979 | Grass | 16/130 X |
| 4,227,284 | 10/1980 | Zernig | 16/130 X |

FOREIGN PATENT DOCUMENTS

| | | | |
|---|---|---|---|
| 2401865 | 7/1975 | Fed. Rep. of Germany | 16/131 |

*Primary Examiner*—Wayne L. Shedd

*Attorney, Agent, or Firm*—Wenderoth, Lind & Ponack

[57] ABSTRACT

A hinge for a furniture door includes a hinge arm which carries the hinge links. The hinge arm is mounted on a mounting plate, and the latter is fixed on a furniture side wall. The hinge arm is secured to the mounting plate by means of screws and by means of such screws is also adjustable with respect to the mounting plate. The mounting plate is made of sheet metal and has a U-shaped cross-section. The two lateral flanges of the mounting plate rest on the furniture side wall.

6 Claims, 4 Drawing Figures

HINGE

BACKGROUND OF THE INVENTION

1. Field of the Invention

The invention relates to a mounting plate for furniture hinges, a hinge arm carrying hinge links being anchored to the mounting plate by means of a fastening screw and an adjusting screw for adjustment of the hinge joint, the adjusting screw being retained in a female thread of the hinge arm.

2. Description of the Prior Art

Furniture hinges with mounting plates of the above-mentioned kind are widely used in modern furniture production. A furniture door should be securely held on the body of a piece of furniture by means of these hinges. The hinge arm being linked to the hinge casing, which is inserted in the furniture door, by means of the hinge links, when the furniture door is mounted on its hinges, should be fastenable to the mounting plate in an easy and secure manner. Moreover, a possibility for adjustment should be provided in order to overcome tolerances which may be due to the drilling of fastening holes.

SUMMARY OF THE INVENTION

It is the object of the invention to provide a mounting plate of the above-described kind, which facilitates the mounting and anchoring of the hinge arm and guarantees low cost of production and a particularly secure support of the hinge arm on the mounting plate.

According to the invention, this is achieved by providing a mounting plate, preferably of sheet metal, having a U-shaped cross-section, the two lateral flanges of the mounting plate resting against the furniture part in the mounted position, and by arranging a slot on at least one end of the mounting plate. The slot is open towards the front face of the mounting plate. An adjusting screw for the adjustment of the joint extends through the slot, with a head of the adjusting screw bearing against the inner side of the center flange of the mounting plate.

A preferred embodiment provides that the two longitudinal rims of the slot are staggered with respect to each other in direction of the height of the mounting plate. Due to the fact that the rims of the slot for the joint adjusting screw are thus staggered, it is possible to incline or tilt the hinge arm during mounting, so that the adjusting screw for the joint adjustment glides easily in the slot. When tightening the fastening screw, the mounting plate braces in the groove of the cross adjustment screw, i.e. the adjustment screw for the joint adjustment.

It is preferably provided that the mounting plate is punched of sheet metal and that the center flange is bent into the profile on one side of the slot, whereby the costs of the mounting plate are kept particularly low.

It has proved particularly advantageous when the longitudinal rims of the slot are staggered by approximately the thickness of the center flange.

BRIEF DESCRIPTION OF THE DRAWINGS

In the following an embodiment of the present invention will be described in more with reference to the accompanying drawings, wherein.

DETAILED DESCRIPTION OF THE PREFERRED EMBODIMENT

Figure 1:
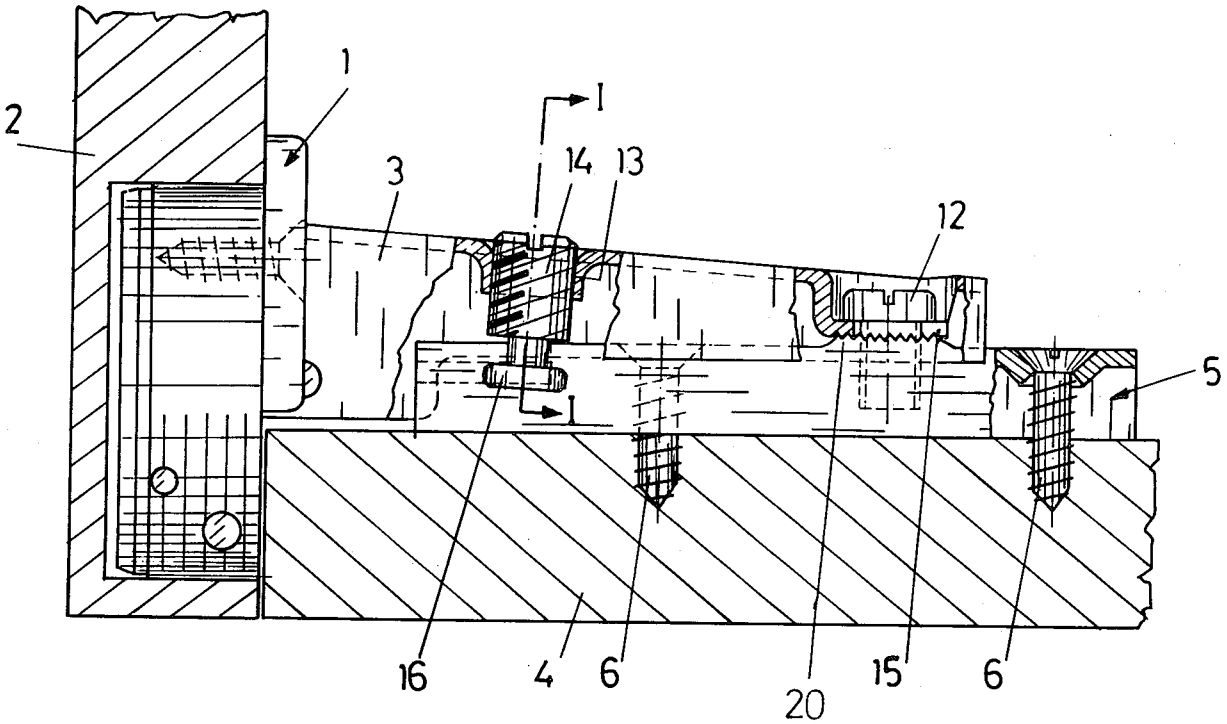
FIG. 1 is an elevation side view, partially in section, of a hinge with a mounting plate in accordance with the present invention, shown assembled to an article of furniture.

In the present embodiment, the hinge comprises a hinge casing 1 inserted into a furniture door 2, a hinge arm 3 connected with the hinge casing 1 by means of hinge links, which are not illustrated (in FIG. 1 hinge link axles are indicated only on the hinge arm 3 and in the hinge casing 1). The connection between the hinge casing 1 and the hinge arm 3 need not be described in detail, as this kind of hinge joint is well known in the art and is not subject of the present invention.

A mounting plate 5 is fastened to a furniture side wall 4 by means of screws 6.

Figure 3:
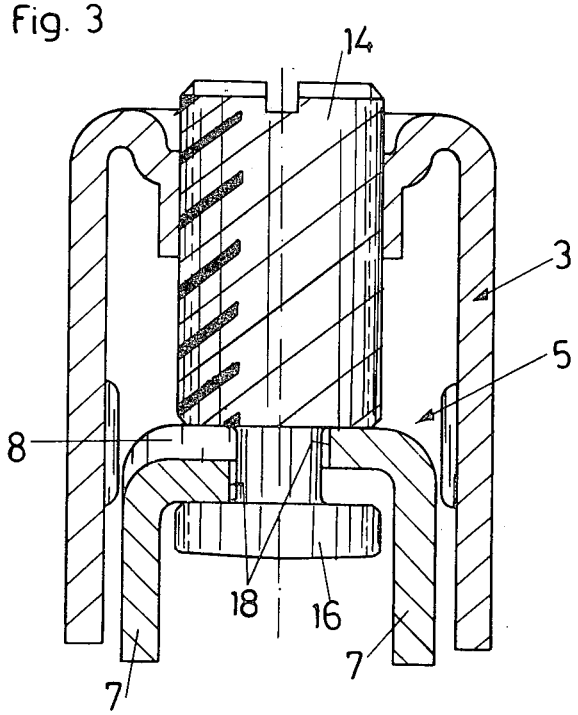
FIG. 3 is a sectional view along line I—I of FIG. 1.
Figure 2:
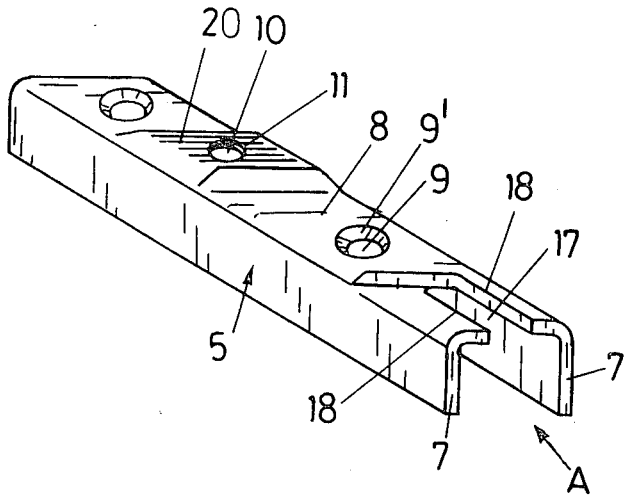
FIG. 2 is a perspective view of a mounting plate in accordance with the present invention.
Figure 4:
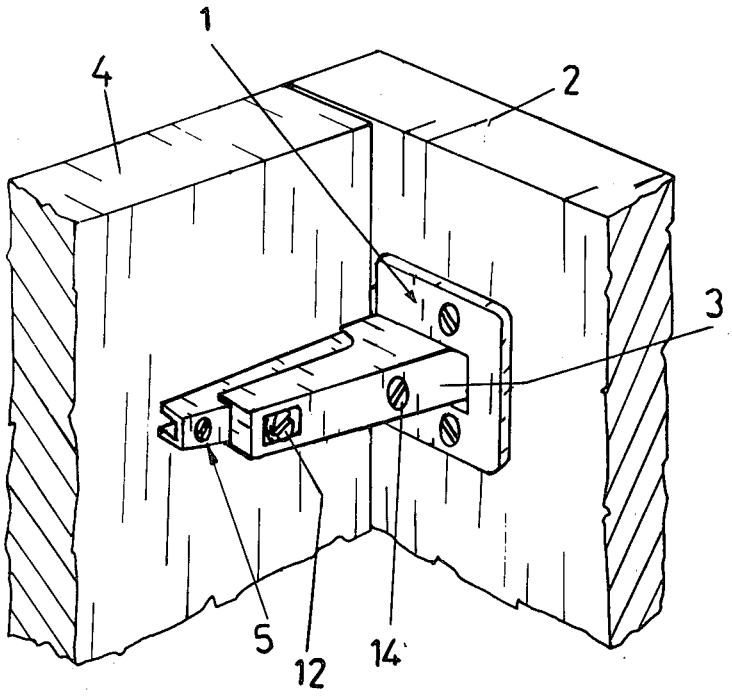
FIG. 4 is a perspective view of the assembly of FIG. 1.

As can be seen in FIGS. 2 and 3, the mounting plate 5 has a U-shaped configuration and rests in the mounted position with its two side flanges 7 against the furniture side wall 4. In the center flange or web 8 of the mounting plate 5 holes 9 and bevelled recesses 9' are provided for the screws 6 and screw heads, respectively. A further hole 10, which is provided with a female thread 11, is arranged in the center flange or web 8, such female thread receiving a fastening screw 12 when the hinge arm is in the mounted position. In the region of hole 10 the mounting plate 5 is provided with a base 20.

An adjusting screw 14 for adjustment of the joint is mounted in a female thread 13 of the hinge arm 3. The rear end of the hinge arm 3 is provided with a slot 15, which is open in the backward direction and through which the fastening screw 12 extends in the mounted position.

When putting the furniture door 2 on its hinges, i.e. when mounting the hinge, the hinge arm 3 carrying the adjusting screw 14 is pushed onto the mounting plate 5 from the front face (from the direction of arrow A of FIG. 2) in such a manner that hinge arm 3 is on its free end pushed between the mounting plate 5 and the head of the fastening screw 12 and that on the front face a head 16 of the adjusting screw 14 is placed below the center flange or web 8 of the mounting plate 5, whereby the adjusting screw 14 projects through a slot 17 in the center flange or web 8 of the mounting plate 5, slot 17 being open in the forward direction.

As can be seen in FIGS. 2 and 3, longitudinal rims or edges 18 of the slot 17 are staggered or offset with respect to one another by approximately their thickness, i.e. by a measure x. One rim 18 is arranged substantially on an inwardly bent flap of the center flange or web 8 of the mounting plate 5.

By turning the adjusting screw 14, the furniture door 2 can be adjusted with respect to the breadth of the door joint. The hinge arm 3 can be adjusted with respect to the depth of the piece of furniture over the length of the slots 17 and 15. After adjustment of the joint and depth of the piece of furniture, the hinge arm 3 is secured to the mounting plate 5 by tightening the fastening screw 12, which then clamps the hinge arm 3.

What is claimed is:

1. A furniture hinge comprising:

a mounting plate having a substantially U-shaped cross-sectional configuration including a pair of lateral flanges adapted to rest against a furniture part in a mounted position and a center web joining said lateral flanges, and having a front adapted to be directed toward a furniture door;

said mounting plate having in at least one end thereof a longitudinally extending slot opening toward the front of said mounting plate and defined by a pair of longitudinally extending edges, said pair of edges being staggered with respect to each other in the direction of the height of said mounting plate as measured from those portions of said lateral flanges adapted to rest against the furniture part;

a hinge arm carrying hinge links and adapted to be clamped to said mounting plate;

an adjusting screw for adjusting the relative position of said hinge arm with respect to said mounting plate, and for thereby adjusting the furniture joint, said adjusting screw being retained in a threaded opening in said hinge arm;

said adjusting screw, when said hinge arm is mounted on said mounting plate, extending through said slot in said mounting plate and having a head bearing against an underside of said center web of said mounting plate; and a fastening screw for fixedly clamping said hinge arm to said mounting plate.

2. A hinge as claimed in claim 1, wherein said mounting plate is formed of sheet metal, and said slot is formed in said center web such that one of said edges is defined by a rim portion of said center flange.

3. A hinge as claimed in claims 1 or 2, wherein said pair of edges are staggered with respect to each other by an amount approximately equal to the thickness of said center web.

4. A mounting plate for use in a furniture hinge of the type including a hinge arm having hinge links and adapted to be anchored to said mounting plate by means of an adjusting screw threadably retained in the hinge arm for joint adjustment and by means of a fastening screw, said mounting plate comprising:

a substantially U-shaped member including a pair of lateral flanges adapted to rest against a furniture part in a mounted position and a center web joining said lateral flanges, and having a front adapted to be directed toward a furniture door;

said member having in at least one end thereof a longitudinally extending slot opening toward the front of said member and defined by a pair of longitudinally extending edges, said pair of edges being staggered with respect to each other in the direction of the height of said mounting plate as measured from those portions of said lateral flanges adapted to rest against the furniture part; and said center web of said member having an underside adapted to be abutted by a head of the adjusting screw when the hinge arm is mounted on said mounting plate.

5. A mounting plate as claimed in claim 4, wherein said member is formed of sheet metal, and said slot is formed in said center web such that one of said edges is defined by a rim portion of said center flange.

6. A mounting plate as claimed in claims 4 or 5, wherein said pair of edges are staggered with respect to each other by an amount approximately equal to the thickness of said center web.

* * * * *